United States Patent [19]

Gonnason

[11] 4,398,673

[45] Aug. 16, 1983

[54] METHOD OF CLASSIFYING AND COMMINUTING A GYPSUM ORE OR THE LIKE

[75] Inventor: Walter L. Gonnason, Coopersville, Mich.

[73] Assignee: Domtar Industries Inc., Montreal, Canada

[21] Appl. No.: 210,011

[22] Filed: Nov. 24, 1980

Related U.S. Application Data

[63] Continuation-in-part of Ser. No. 158,947, Jun. 12, 1980, abandoned.

[51] Int. Cl.[3] ..... B02C 19/06; B02C 23/08

[52] U.S. Cl. ..... 241/5; 241/14; 241/24; 241/29; 241/275

[58] Field of Search ..... 241/5, 14, 24, 70, 275, 241/27, 29

[56] References Cited

U.S. PATENT DOCUMENTS 1,702,940 2/1929 Haire ..... 241/14

2,012,155 8/1935 Behnke ..... 241/14 X 3,912,174 10/1975 Karpinski et al. ..... 241/5 X

*Primary Examiner*—Mark Rosenbaum

*Assistant Examiner*—Timothy V. Eley

*Attorney, Agent, or Firm*—Price, Heneveld, Huizenga & Cooper

[57] ABSTRACT

A method is disclosed for separating a relatively soft component from a relatively hard component of mineral ore and then comminuting the softer component. The separation is performed by impact crushing the ore to reduce the softer component to particulate material of a smaller dimension than that of the harder component after which the components are separated by screening. The comminution is performed by further impact crushing the softer component to further reduce same and separating sufficiently small particles. Relatively large particles are also removed and the remainder of the softer component is recycled through the comminution process. The method is primarily applicable to the separation of chert from gypsum and comminuting the gypsum in the processing of gypsum ore.

6 Claims, 4 Drawing Figures

METHOD OF CLASSIFYING AND COMMINUTING A GYPSUM ORE OR THE LIKE

BACKGROUND OF THE INVENTION

This is a continuation-in-part of application Ser. No. 158,947, filed June 12, 1980, now abandoned.

In the mining industry, the ores extracted from the mine normally contain more than one mineral, and in most cases, one or more of the component minerals is one which is undesirable and must be separated from the desired mineral component of the ore. The undesirable component may or may not be useful after it has been separated. Its individual utility does not change the fact of its contaminant effect when mixed with the primary mineral component. This invention is particularly intended for use with ores having components of substantially different hardness characteristics.

How the components are separated varies widely, depending upon the particular type of ore and the particular mineral to be recovered. The present invention is primarily intended for use in the mining of gypsum ores. In the case of gypsum ores the more common floatation method used with many metallic ores is possible but not economically feasible. Gypsum is relatively soft and friable. In some cases the ore extracted from the mine contains materials which are much harder than the gypsum and are much less friable. Some of these materials such as chert, having a high silica content, are extremely hard, abrasive and resistant to impact and crushing forces. These materials are not desirable in the final product or during the processing because of the hardness, abrasiveness and resistance to crushing resulting in excessive wear on the equipment used for reducing the ore. The undesirable materials in the case of gypsum do not enter into the subsequent reaction by which the final plaster products are produced. Therefore, their presence tends to make the product inferior.

The most common use of gypsum is the manufacture of plaster and of building materials having a plaster component such as dry wall or plaster board. To manufacture this material, the gypsum must be comminuted to a powder and dehydrated to drive off the water of crystalization. This comminution is commonly performed using a ball mill. The material after calcining can be reconstituted in the shape and form desired by restoring the water of crystalization. In the process, the material has to be reduced to a fine powder and it is in this process that hard materials, such as chert, cause excessive equipment wear. While it is possible to crush all the ore to a powder, this is neither desirable nor practical. The resulting mixture of the gypsum and the crushed, hard materials results in an inferior product. If the ratio of the hard materials exceeds certain limits, the product becomes unacceptable. In addition, the equipment wear is excessive even though wear resistant types of equipment are used. Prior art comminution equipment is also relatively energy inefficient. Further, it may necessitate the use of equipment of a type which is far more costly than that which would have been necessary if little or none of the hard component were present.

Previous attempts to separate the hard materials from the gypsum have not been satisfactory because excessive amounts of the gypsum were carried away or lost with the hard material, thus materially reducing the efficiency of utilization of the ore as extracted from the mine. Previous attempts to comminute the gypsum component have not been satisfactory because equipment wear is excessive and the equipment is energy inefficient. An object of this invention is to significantly reduce this loss of gypsum and to provide a method for effectively separating a much higher percentage of the hard, abrasive components of the ore than has heretofore been possible. Another object of the invention is to provide a separation method which operates rapidly at a relatively low cost factor in both energy and manpower. It is also a continuous, rather than a batch process. A further object of the invention is to provide a comminution method which will not cause excessive wear to expensive machine parts. An additional object of the invention is to provide a comminution method which operates rapidly at a relatively low cost factor in both energy and manpower. The comminution process is also a continuous, rather than a batch, process.

BRIEF DESCRIPTION OF THE INVENTION

This invention for the first time provides a method for processing gypsum ore from the mine head crusher to the calcining process utilizing only two basic steps which perform the dual functions of concentration through classification and separation and reduction of the gypsum component to powder of a size suitable for calcining. Furthermore, the method accomplishes this as a high volume, continuous process using equipment which occupies a small fraction of the plant space required for the equipment conventionally used in processing gypsum.

The invention utilizes the differential in friability between gypsum and the undesirable components of the ore. Gypsum is a relatively soft and readily friable mineral. As such it can be readily reduced by impact to a material of small particle size. The most commonly encountered hard materials are much more impact resistant and do not shatter as readily. It is this differentiation which is utilized in this invention.

In practicing the invention, in the first stage the mine ore is first crushed into lumps of several inches in cross section. These lumps are than impacted with an impact force designed to be effective in fracturing a substantially greater proportion of the gypsum component than of the harder, undesirable components. This results in breaking up the ore into particles of different sizes with the friable gypsum component forming a substantial majority of the particles of smaller size while the harder materials generally remain as particles of larger size. Having thus differentiated by size the gypsum component from the harder components of the ore, the two are separated or classified by passing over a screen of suitable mesh such that the gypsum component will pass through and the larger, hard particles will be retained.

In the second stage the gypsum component is then impacted a second time with a higher impact force designed to fracture a substantially greater proportion of the gypsum component than of the harder, undesirable rock which might remain embedded in the gypsum component. This further reduces the gypsum component into particles of different sizes, which are screened to remove those particles which are sufficiently small to be used in futher manufacture and also screened to remove the larger particles which are generally pieces of the harder rock remaining in the gypsum component. The particles remaining after these two screenings is then reintroduced at the second impacting step until all of these particles have also been sufficiently reduced.

This recycling is continuous so that some of the ore will make multiple passes through this second stage before being sufficiently comminuted.

In an alternative embodiment of the invention, classification is performed using an air separator rather than physical screens.

DESCRIPTION OF THE INVENTION

The gypsum ore, as it is received from the mine, is normally in chunks of a wide variety of sizes. The first step in preparing the ore is to pass it through a crusher to reduce the ore to lumps of a reasonably uniform size. A preferred size for the resulting lumps is six to eight inches in cross section, but lumps in the range of two to eight inches can be utilized. It is important that the size of the lumps used during a particular run be restricted to size differential in the range of 1.5 to 2 inches. This is a conventional step in the processing of gypsum rock.

Figure 1:
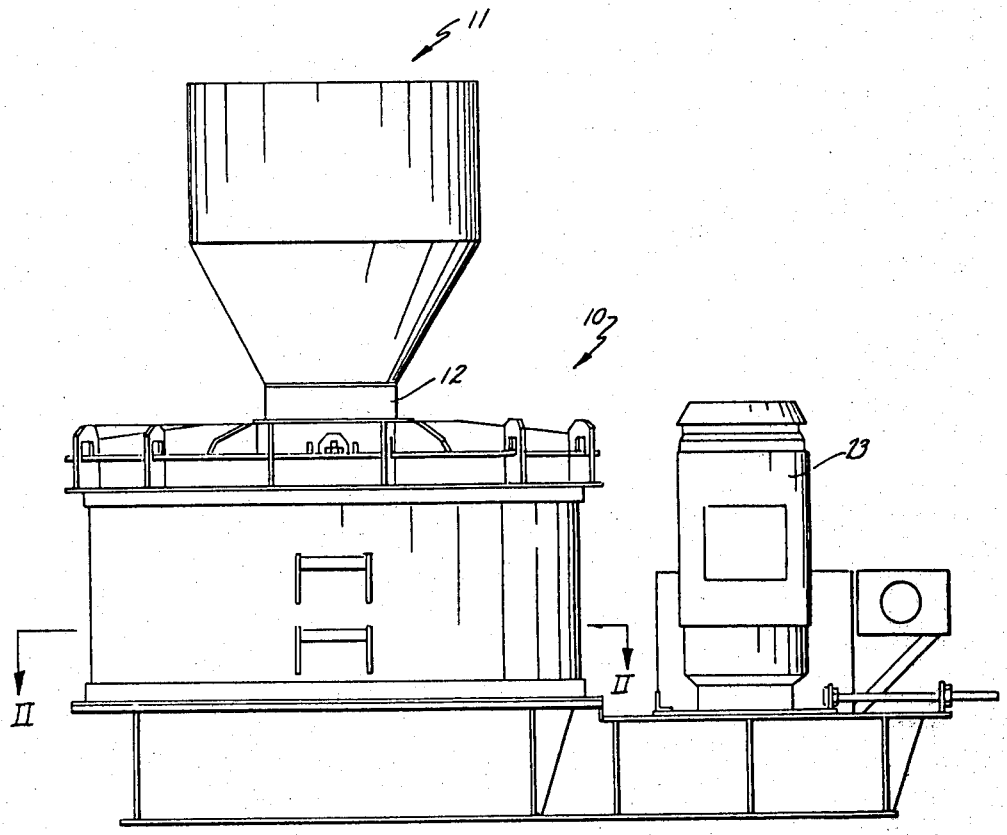
FIG. 1 is a side elevation view of the centrifugal impact crusher suitable for practicing this invention.
Figure 3:
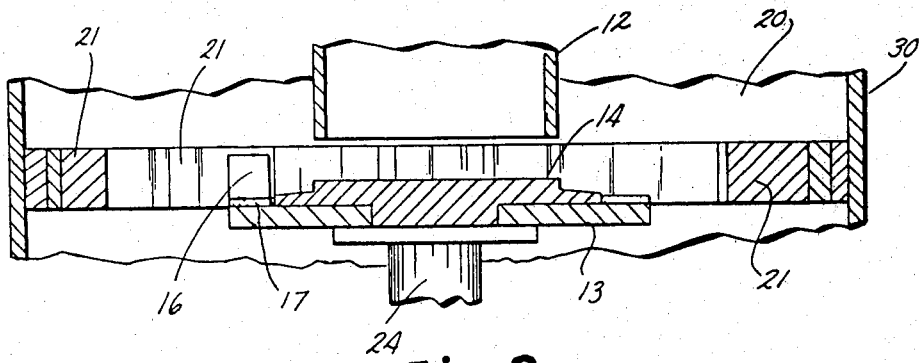
FIG. 3 is a sectional view of the crusher chamber taken along the plane III—III of FIG. 2.

The lumps resulting from the initial crushing are fed to a rotary impact crusher 10 (FIG. 1). The ore is fed through the top of the crusher at 11 and passes down through a central chute 12. The bottom of the chute discharges the ore onto a spinning accelerator plate 13. The central portion of the plate has a circular cap 14 the outer top edge of which is chamfered. The diameter of the cap is at least equal to the diameter of the bottom of the chute. The portion of the plate extending radially outwardly beyond the periphery of the cap 14 is divided into a plurality of pockets 15 separated from one another by partitions or shoes 16. Between the shoes the surface of the plate is covered by replaceable wear strips 17.

The chute 12 and the accelerator plate 13 are centered in a crushing chamber 20. The outer wall 30 of the crushing chamber facing the pockets 15 is lined with a plurality of impact plates or anvils 21. These are arranged in a circle with each one having a traget or impact face 22 positioned such that it is normal to the trajectory of material thrown off the accelerator plate by centrifugal force.

The target plates or anvils 21 are preferably of a very hard material which can withstand the repeated, abrasive affect of the ore as it strikes these plates. Because this is a highly abrasive operation, the anvils 21 are designed to be replaceable.

The accelerator plate is mounted to the upper end of a vertical shaft 24 which is suitably driven from a prime mover such as the electric motor 23. Preferably, the prime mover is equipped with variable speed control means.

Applicant does not claim invention of the equipment which has been described and, in fact, in its process is utilizing a piece of equipment manufactured by Spokane Crusher Manufacturing Company, known as a Spokane Centrifugal Impact Crusher. However, it was necessary to modify the operation of the crusher to adapt it to the practice of this invention.

It is important in the practice of the invention that the lumps be accelerated to a speed such that when they impact against the target or anvil, the force of the impact will be effective to fracture the more friable component, in this particular case, the gypsum, without substantially fracturing the harder, less friable component, for example, the chert. The peripheral speed of the plate, the distance between the plate periphery and the target or anvil face are very important factors in producing the correct impact force. Since it is an expensive and time consuming procedure to vary the distance between the plate periphery and the anvils, the most readily variable factor is the speed of the plate.

Figure 2:
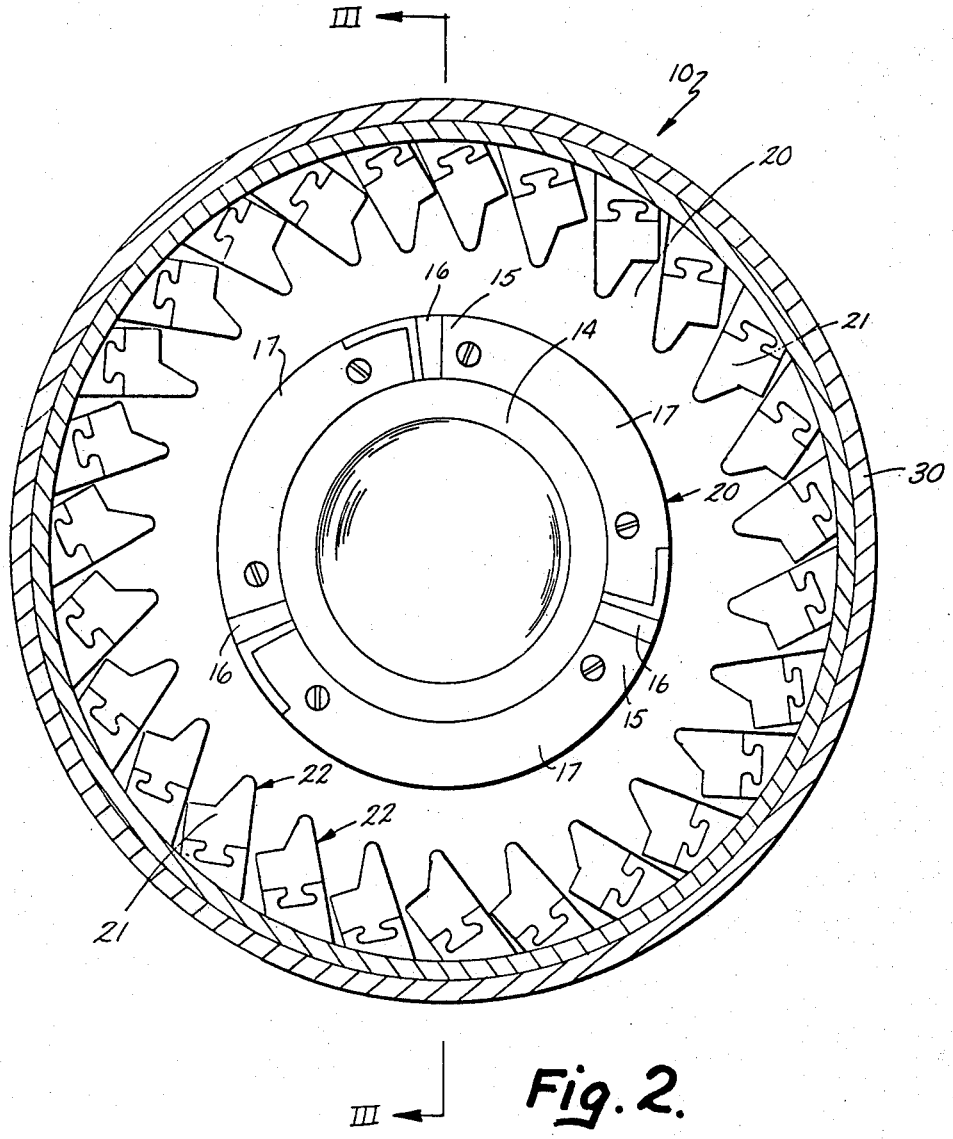
FIG. 2 is a sectional view of the crusher chamber taken along the plane II—II of FIG. 1.

While the most effective impact force will vary from one type of ore to another, a series of tests have established that for the purpose of separating the gypsum component (having a Mohs hardness of 2) from the chert component (having a Mohs hardness of 6), a crusher having an accelerator plate 13 of 37.25 inches diameter and a tangential distance A (FIG. 2) from plate periphery to the impact face 22 of the anvils 21, measured normal to the face of the anvil, of 25.25 inches, the plate should be operated at 800 r.p.m. resulting in a peripheral velocity of 7,800 feet per minute. This was found to be effective with lump sizes in the range of four to six inches across. In this case, the process was used to separate the gypsum component from chert which existed as a vein in the ore. After the material had been crushed, it was separated by means of vibratory screens with the screen size selected to permit the smaller particles of gypsum to pass through while the larger particles of chert were retained. For this purpose, screens having a mesh of $\frac{3}{8}\times\frac{1}{2}$ inch were used. However, screens having a mesh of $\frac{1}{2}\times\frac{1}{2}$ inch can be used. The product passing through this screen is referred to as first stage product. This first stage product may be passed through an air separator having a 100 mesh separation point which removes the 100 mesh gypsum which is sent to the calciners and further processed. However, this step is not necessary.

The following table reports statistically the results of five runs utilizing this method for separating the gypsum and the chert components. The ore, as it was received from the mine in this case, was approximately 8% chert. Which technically is sandy dolomite partially altered to chert. The waste product is approximately 60% chert and shale and 40% gypsum of the total gypsum ore obtained from the mine. Thus, for every 100 tons of ore, this invention removes 17 tons of waste product which includes 6.8 tons of gypsum and 10.2 tons of undesirable material which is a mixture of chert, shale and limestone. The tests to date indicate that as the speed of the accelerator plate is increased, the size of the screen can be increased from a $\frac{3}{8}\times\frac{1}{2}$ inch mesh to a $\frac{1}{2}\times\frac{1}{2}$ inch mesh. The tests also indicate that the most desirable ore size is the 2 to $3\frac{1}{2}$ inch range so far as first stage crushing is concerned. However, by using the larger size ore lumps, the wear on the initial roll crusher is reduced sufficiently to justify the reduction in efficiency of the first stage impact crushing operation.

TABLE I

| SPOKANE FEED | | | | | TO MILL | | | | DISCARD | | | | TO MILL TOTAL | | |
|---|---|---|---|---|---|---|---|---|---|---|---|---|---|---|---|
| PLATE R.P.M. | ORE SIZE INCHES | SCREEN SIZE INCHES | T./HR. | % GYP. | T. GYP. PER HR. | % GYP. PER HR. | T. IMP. PER HR. | % IMP. PER HR. | T. GYP. PER HR. | % GYP. PER HR. | T. IMP. PER HR. | % IMP. PER HR. | T/HR. | %/HR. | % GYP. |
| 800 | 2-2½ | ⅜ × ½ | 12.6 | 76.2 | 7.4 | 58.8 | 1.5 | 12.2 | 1.6 | 12.5 | 2.1 | 16.5 | 8.9 | 71.0 | 82.8 |
| 960 | 2-2½ | ⅜ × ½ | 20.7 | 76.3 | 13.8 | 66.3 | 3.1 | 15.2 | 1.0 | 4.9 | 2.8 | 13.5 | 16.9 | 81.5 | 81.4 |
| SERIES 1-2-3 12 - 18+19 - 1979 | | | | | | | | | | | | | | | |
| 800 | 3½-4 | ½ × ½ | 21.5 | 75.8 | 15.2 | 70.5 | 3.2 | 15.1 | 1.0 | 4.6 | 2.1 | 9.8 | 18.4 | 85.6 | 82.4 |
| SERIES 4 12 - 20+21 - 79 | | | | | | | | | | | | | | | |
| 960 | 3½-4 | ½ × ½ | 20.8 | 75.1 | 15.2 | 73.4 | 4.0 | 19.0 | 0.4 | 2.1 | 1.2 | 5.5 | 19.2 | 92.4 | 79.4 |
| SERIES 5 12 - 28 - 79 | | | | | | | | | | | | | | | |
| 800 | 4-4½ | ½ × ½ | 26.4 | 76.2 | 19.0 | 71.7 | 4.1 | 15.8 | 1.3 | 4.8 | 2.0 | 7.7 | 23.1 | 87.5 | 82.0 |

After initial separation of the chert, the first stage product is further comminuted. Because the chert and gypsum occur in irregular formations, some of the gypsum is trapped within pockets and recesses in the chert, and likewise some chert is trapped within gypsum. The first step of the second stage comminution is to impact the first stage product against a hard stationary surface with an impact force selected to further fracture a substantial proportion of the gypsum component without substantially shattering to the same degree the harder, undesirable component which may be embedded with the gypsum component.

This second stage impacting is performed using a rotary impact crusher identical in structure to the crusher used in the first stage impacting described in this application at pages 5 to 6. The only difference between these two crushers is their size with the first denominated an "82 inch" crusher having an accelerator plate 37.25 inches in diameter and the second denominated a "66 inch" crusher having an accelerator plate 28.375 inches in diameter. Because these two rotary impact crushers are identical with the exception of size, it is unnecessary to repeat a detailed description of the construction of the second crusher.

Although the second crusher is smaller than the first crusher, it produces a higher impact velocity by operating at a higher rotational speed. Consequently, when the first stage product passes through the second rotary crusher, the gypsum is further reduced to particles much smaller in size. As with the first rotary crusher, the most effective impact force will vary with the type and quality of the ore fed into the crusher. A series of tests have established that for the purpose of comminuting the gypsum component, a crusher having an accelerator plate 28.375 inches in diameter and a tangential distance from plate periphery to the impact face of the anvils, measured normal to the face of the anvil, of 16.5 inches, the plate should be operated at 2100 rpm; however, the speed may be varied between 1900 and 2200 rpm. This was found to be effective with gypsum component pieces ½ inch in cross section or smaller (as contained in the first stage product).

After the first stage product has passed through the second crusher, it is then classified using either vibratory screens or an air separator allowing the smallest particles to pass through while the remainder of the mixture is retained. For this purpose, either 100 mesh screens or an air separator having a 100 mesh separation point is used. Gypsum particles 100 mesh (0.0058 inch) or smaller are sufficiently small to be used in the subsequent manfacturing steps and consequently are, therefore, called finished product. This finished product is then sent to the calciners for further processing. Screens or separators having different separation points may be used depending on the specific application and the size particles to be removed.

Because chert is often embedded with the gypsum component introduced into the second crusher, additional chert will be released during the second impacting step. These particles of chert will be larger than the more friable gypsum particles. Therefore, the second stage mixture must also be screened or otherwise classified to separate the largest particles consisting primarily of chert. For this purpose, either 20 mesh (0.0331 inch opening size) screens or an air separator having a 20 mesh separation point may be used. Again, screens or separators having different separation points may be used depending upon the particular application.

The incompletely crushed particles in the mixture produced by the second impacting step, which have a size in between those particles removed by the two screening operations, are then reintroduced into the second impact crusher so that they will be further reduced. This imcompletely crushed material is continuously recycled through the second crusher until it will pass through the 100 mesh separator. The sequence of these two screening operations performed subsequent to the second impacting step is not important and may be varied depending upon the application, i.e. either the largest particles or the smallest particles may be removed first and the other second. Usually, both (1) the gypsum component separated from the chert during the first impacting and screening steps and (2) incompletely crushed material from the second impacting step are simultaneously introduced into the second crusher. The proportion of these two materials is not important so long as the total does not exceed the capacity of the crusher.

Table II reports the results of four runs utilizing the second stage crusher to further concentrate and comminute the gypsum component. Each of the four samples was a first stage product having been processed through the first crusher at 800 r.p.m. Approximately 28% of the resulting second stage product is larger than 20 mesh, 45% 20 to 100 mesh, and 27% smaller than 100 mesh. The finished product (i.e. smaller than 100 mesh) is between 76.5% and 82.78% gypsum. These tests indicate that comminuted gypsum produced by the method of the present invention is well within industry standards for purity.

TABLE II

| | Sample #1 | | Sample #2 | | Sample #3 | | Sample #4 | |
|---|---|---|---|---|---|---|---|---|
| Mesh Size | % Material Retained | % Purity | % Material Retained | % Purity | % Material Retained | % Purity | % Material Retained | % Purity |
| 20 | 27.53 | 72.25 | 26.72 | 66.51 | 30.33 | 69.38 | 26.81 | 69.86 |
| 80 | 38.47 | 78.95 | 40.75 | 80.86 | 37.34 | 76.08 | 39.64 | 77.04 |
| 100 | 5.45 | 78.95 | 4.79 | 81.34 | 3.83 | 82.30 | 11.93 | 79.43 |
| 200 | 13.63 | 79.43 | 13.31 | 78.00 | 13.87 | 78.00 | 9.39 | 80.39 |
| 325 | 4.46 | 75.12 | 3.92 | 78.47 | 4.07 | 83.74 | 1.90 | 78.95 |
| PAN | 10.46 | 76.56 | 10.51 | 78.00 | 10.56 | 76.56 | 10.33 | 78.95 |

Because the gypsum component and the chert component have substantially different hardnesses, a variety of impact velocities may be selected which will substantially fracture the gypsum component without substantially fracturing the chert. Therefore, the impact velocities of the first crusher may be varied, which in turn will vary the percentage of gypsum in the mixture initially introduced into the second crusher.

As the speed of the first crusher is reduced, the chert is left in larger pieces so that the first screening produces a more pure gypsum component because more of the chert is screened off; however, the feed rate must be proportionately reduced with the lower speed. Furthermore, gypsum embedded in the larger pieces of chert is discarded with the chert. This also causes a smaller percentage of the gypsum to be recovered because that gypsum enbedded in the chert is lost. Consequently, although the gypsum component produced using this lower speed contains a relatively high percentage of gypsum, the feed rate must be reduced decreasing the output of the process and more gypsum remains with the chert. On the other hand, if the velocity of the initial rotary crusher is increased, a greater proportion of the chert will be broken into pieces small anough to pass through the first screening step with the gypsum component resulting in a less pure mixture. However, the increased speed allows the feed rate to be increased and more gypsum is released from the chert, so that less gypsum is discarded with the chert.

The purity of the gypsum component fed into the second crusher partially determines how efficiently that crusher will operate, i.e. how many passes will be required to comminute the gypsum and increase its purity to an acceptable level. Consequently, operating the first crusher at a high feed rate will cause the second crusher to operate less efficiently, while operating the first crusher at a low feed rate will enable the second crusher to comminute the gypsum component rapidly. I have discovered through extensive testing that the speeds indicated above provide the highest composite feed rate for the 100 mesh particle size of comminuted gypsum generally required in fabricating gypsum products. At the same time it results in a product of increased purity.

Additionally, the gypsum may be partially dried by introducing hot air during the second stage impacting step. The heat could be supplied from flue gases resulting from the principle calcining process in which the water of crystallization of the comminuted gypsum is driven off.

The energy savings effected with the method of the present invention are significant. Previously, a Cedar Rapids hammer mill powered by a 150 horsepower motor, a Jeffery hammer mill powered by a 100 horsepower motor, and two ball mills each powered by a 100 horsepower motor (a total of 450 horse power) were required to comminute the gypsum. The first and second rotary crushers of the present invention are powered by 150 and 100 horse power motors respectively (a total of 250 horse power). Furthermore, the present method produces a 50 percent greater throughput than the prior process. Consequently, the process of the present invention uses approximately only ⅓ the energy of the prior process on an identical volume of material. This energy saving both reduces the cost of the end products and conserves scarce resources.

Furthermore, the plant space required for the two crushers of the present invention is far smaller than the prior art separation and comminution equipment. Consequently, large portions of the plant may be closed off eliminating the associated operating expenses such as heating, lighting and ventilation.

Figure 4:
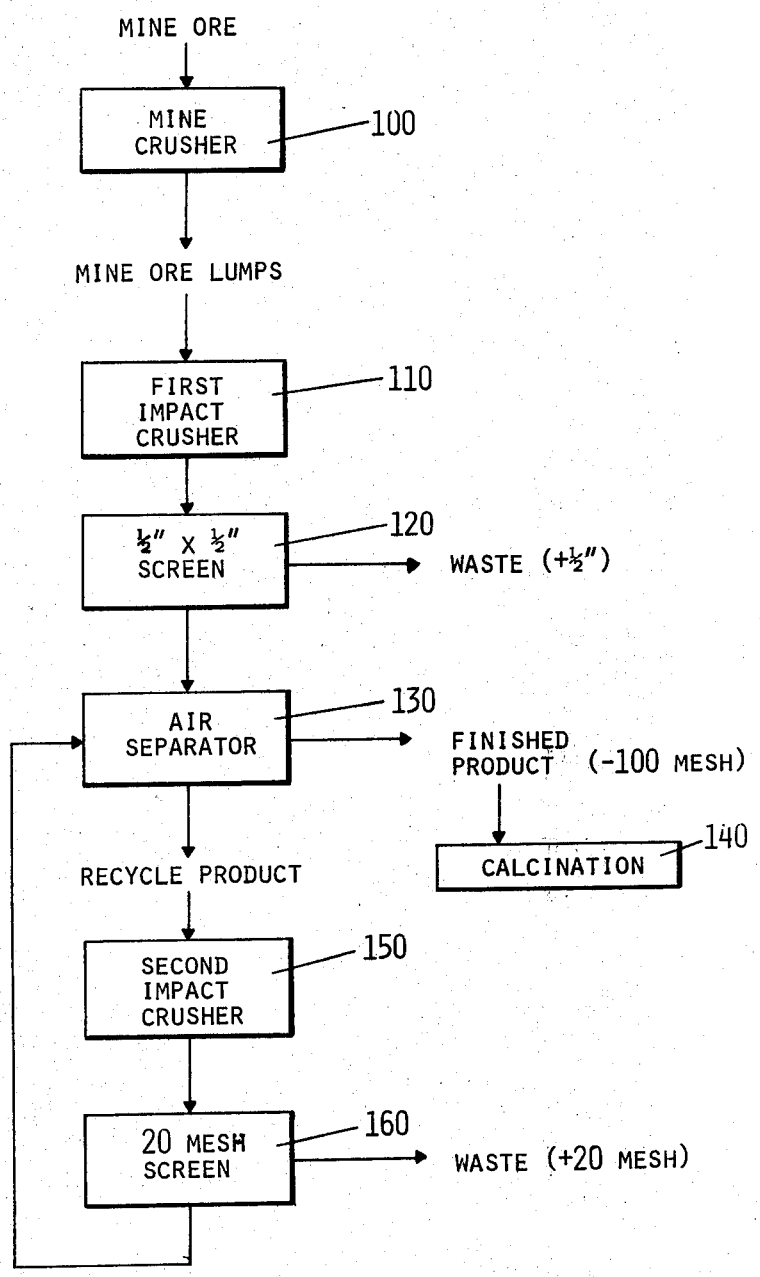
FIG. 4 is a flow chart of the process.

The classification and comminution process is graphically illustrated in the flow diagram of FIG. 4. The mine ore is first reduced to lumps by crushing the same in mine crusher 100. These lumps are then introduced into the first impact crusher 110, and the resulting mixture is screened over a ½ inch × ½ inch screen 120. The material greater than ½ inch in cross section is primarily chert and discharded as waste. The material passing through the screen is passed through air separator 130 which has a separation point of approximately 100 mesh. Those particles which are 100 mesh or smaller are separated and collected as a finished, completely comminuted product and sent on to calcination 140. The remaining material is the recycle product and is introduced into the second impact crusher 150. This second stage crusher mixture is then passed over a 20 mesh screen 160 to separate waste material, again primarily chert, greater than 20 mesh in cross section. The material passing through screen 160 is then recycled into air separator 130 along with material introduced from screen 120. The material passing through screen 160 is constantly recycled in this manner until fully comminuted to 100 mesh or smaller so that same may proceed to calcination 140.

It will be understood that if this process is to be applied to an ore having different friability characteristics than the combination of gypsum and chert, the impact force and, therefore, the speed of the accelerator plate will have to be adjusted accordingly to either increase or decrease the impact force against the anvil. For this purpose it will be necessary to run sufficient tests to find the most satisfactory compromise between a force which is effective to shatter the more friable component without shattering any significant proportion of the less friable component. In particular it is foreseen that this process could be used to separate pyrite and common base rocks from coal, reducing both the sulfur and shale content thereof. Additionally, this process could be used to separate tungsten from either limestone or granite found in scheelite ore. The process could also be used to separate lead from dolomite in galena ore. It is also envisioned that the process could be used to separate chromite, which is extremely hard, from the less friable components in serpentine or olivine ore.

It is not possible to precisely determine the speed for each particular ore because of the wide variation in ore characteristics. It has, however, been determined that the particular operating conditions set out above provide an effective operating condition for the chert containing, high purity gypsum ores of the Southern Michigan area.

Prior to this invention, no effective method had been developed for removing the chert. Thus, all of the chert had to be processed through the crushers. Its presence had many adverse effects. Not only does it result in excessive wear on the ore reduction equipment such as the ball mills, it also causes excessive wear on the regrinders used in preparing the final product and on the cut-off knifes and saws used to trim and cut the plaster board produced from the ore. The cost of this wear is such that the loss of some of the gypsum component in excess of that experienced in conventional processing could have been tolerated. However, this process has the double advantage of reducing processing costs and of increasing the purity and thus the quality of the final product.

A further advantage of this process is that the gypsum particles produced have an elongated or needle-like appearance. Particles produced using the traditional ball mills are more spherically shaped. The needle-like particles may be both calcined and reconstituted more easily and more completely. Furthermore reconstituted gypsum products made from the needle-like particles are stronger because of the stronger bonds between the elongated particles.

While this invention has been described and a particular set of optimum operating conditions have been set forth, it will be recognized that variations may be made in the operating conditions which are within the principles of the invention. Such variations are to be considered as included in the hereinafter appended claims unless these claims by their language expressly state otherwise.

The embodiments of the invention in which an exclusive property or privilege is claimed are defined as follows.

1. A method of concentrating and comminuting the gypsum component of a gypsum ore having gypsum and chert components characterized by substantial differences in hardness, the steps comprising:

reducing the ore to a partially fragmented product by impaction at a velocity in the range of 7,800 to 9,800 feet per minute against a hard surface which will fracture a substantially greater proportion of the gypsum component;

separating by size the partially fragmented product into a first waste product and a first stage product, the first stage product being smaller in size than the first waste product, the particles of the first stage product being in the range of no greater than ½ inch in cross section;

impacting said first stage product at a velocity in the range of 14,100 to 16,400 feet per minute against a hard surface which will fracture a substantially greater proportion of the gypsum component than of the chert component to produce a partially comminuted product;

separating by size the partially comminuted product into finished product, recycle product, and second waste product, the products being of increasing size from finished to second waste product, the particles of the finished product being in the range of no greater than 0.0058 inches in cross section, the particles of the second waste product being in the range of greater than 0.0331 inches in cross section; and returning the recycle product to the impacting step.

2. The method as recited in claim 1 wherein the recycle product is deposited on a revolving accelerator and discharged therefrom by centrifugal force and the hard surface is stationary and normal to the trajectory of the recycle product.

3. A method of concentrating and comminuting the gypsum component of a gypsum ore having gypsum and chert components characterized by substantial differences in hardness, the steps comprising:

as a first stage, reducing the ore to lumps;

impacting the lumps against a first hard surface at a first impact velocity in the range of 7,800 to 9,800 feet per minute which will fracture a substantially greater proportion of the gypsum component than of the chert component to produce a partially fragmented product;

separating by size the partially fragmented product into first stage product and first waste product, the particles of the first stage product being in the range of no greater than 0.5 inches in cross section, the first waste product being larger than the first stage product;

as a second stage, impacting said first stage product against a second hard surface at a second impact velocity in the range of 14,100 to 16,400 feet per minute which will again fracture a substantially greater proportion of the gypsum component than the chert component to product a partially comminuted product;

separating by size the partially comminuted product into finished product, recycle product, and second waste product, the particles of the finished product being in the range of no greater than 0.0058 inches in cross section, the particles of the recycle product being in the range of greater than 0.0058 and no greater than 0.0331 inches in cross section, the particles of the second waste product being in the range of greater than 0.0331 inches in cross section; and returning the recycle product to the second stage for further processing.

4. The method as recited in claim 3 wherein the lumps are deposited on a first revolving accelerator and discharged therefrom by centrifugal force and the first hard surface is stationary and normal to the trajectory of the lumps.

5. The method as recited in claim 4 wherein the gypsum component and the recycle product is deposited on a second revolving accelerator and discharged therefrom by centrifugal force and the second hard surface is stationary and normal to the trajectory of the recycle product.

6. The method as recited in claim 3 wherein the recycle product is deposited on a second revolving accelerator and discharged therefrom by centrifugal force and the second hard surface is stationary and normal to the trajectory of the recycle product.

* * * * *